US009551169B2

(12) United States Patent
Longobardi et al.

(10) Patent No.: US 9,551,169 B2
(45) Date of Patent: Jan. 24, 2017

(54) APPARATUS FOR SECURING A COMPUTING DEVICE TO A SURFACE

(71) Applicant: GLOBALFOUNDRIES INC., Grand Cayman (KY)

(72) Inventors: Giuseppe Longobardi, Castellammare di Stabia (IT); Scot MacLellan, Rome (IT)

(73) Assignee: GLOBALFOUNDRIES INC., Grand Cayman (KY)

( * ) Notice: Subject to any disclaimer, the term of this patent is extended or adjusted under 35 U.S.C. 154(b) by 878 days.

(21) Appl. No.: 13/927,457

(22) Filed: Jun. 26, 2013

(65) Prior Publication Data

US 2015/0005944 A1 Jan. 1, 2015

(51) Int. Cl.

| | |
|---|---|
| ***B25B 11/00*** | (2006.01) |
| ***E05B 73/00*** | (2006.01) |
| *E05C 19/00* | (2006.01) |

(52) U.S. Cl.

CPC ..... *E05B 73/0082* (2013.01); *E05C 19/00* (2013.01)

(58) Field of Classification Search

CPC ..... B25B 11/005; B25B 11/00
See application file for complete search history.

(56) References Cited

U.S. PATENT DOCUMENTS 5,667,208 A * 9/1997 Schroer ..... B25B 11/007 269/21
6,175,926 B1 1/2001 Fogle
6,331,934 B1 12/2001 Helot et al.
6,570,758 B1 5/2003 Maeda
7,142,421 B2 11/2006 Cheng et al.
8,683,676 B1 * 4/2014 Wuester, Sr. ..... G11B 25/043 269/21
2008/0266089 A1 10/2008 Haren et al.
2009/0026677 A1 * 1/2009 Liu ..... B29C 45/14065 269/21
2010/0271761 A1 10/2010 Lev
2013/0025114 A1 * 1/2013 Mizubata ..... H01L 21/6838 29/559

OTHER PUBLICATIONS

Electronic lock for device docking, dated Feb. 20, 2007.
IBM, "An alarm for use of security cables", IPCOM000185219D, date of article Jul. 16, 2009, Copyright Ip.com, Inc., <http://www.ip.com/pubview/IPCOM000185219D>.

(Continued)

*Primary Examiner* — Lee D Wilson
(74) *Attorney, Agent, or Firm* — Scully Scott Murphy and Presser

(57) ABSTRACT

A vacuum based apparatus that will, when activated, inhibit relocation of a computing device. The apparatus includes a first surface of a main body. A suction cup is attached to the main body. The suction cup faces outward from and protrudes from the first surface. The suction cup is connected to a vacuum pump and activation of the vacuum pump generates adhesion between the suction cup and another surface that is in contact with the suction cup. A spacer is attached to and protrudes outward from the first surface. The spacer surrounds at least a part of the suction cup that is protruding from the first surface. A control logic that controls the activation of the vacuum pump.

17 Claims, 5 Drawing Sheets

(56) References Cited

OTHER PUBLICATIONS

IBM, "Method and Apparatus to implement an Anti-Theft mechanism for a laptop/notebook without requiring keys or combinations", date of article Oct. 27, 2009, pp. 1-3, <http://ip.com/IPCOM/000189081>.

"Best Buy Invests 50,000 Hours of Employee Training to Attract Windows 8 Customers", date of article Nov. 9, 2012, < http://web.archive.org/liveweb/http://www.forbes.com/sites/carminegallo/2012/11/09/best-buy-invests-50000-hours-of-employee-training-to-attract>.

QuickSpecs, "HP Docking Stations and HP Advanced Docking Stations for HP Business Notebooks", DA—13449 North America, Version 7, dated Jul. 11, 2011, pp. 1-10, Copyright 2011 Hewlett-Packard Development Company, L.P.

"VMECA VALOCK(Vacuum Auto Lock) System"—VTEC/MECA—PD Nov. 19, 2012, pp. 1-14, The Virtual Industrial Exhibition Direct Industry, <http://pdf.directindustry.com/pdf/vtec-vmeca/vmeca-valock-vacuum-auto-lock-system/15363-90116.html>.

* cited by examiner

APPARATUS FOR SECURING A COMPUTING DEVICE TO A SURFACE

FIELD OF THE INVENTION

The present invention relates generally to the field of security, and more particularly to inhibiting relocation of computing devices.

BACKGROUND OF THE INVENTION

Computing devices can be expensive to replace. Often, these computing devices contain sensitive information about the owner of the computing device. The inherent cost of the computing device and the sensitive information contained therein can make the computing device a tempting target for criminal activity. As computing devices, such as laptops, have become more prevalent, there has been an increased need to prevent such criminal activity. However, the portability of many computing devices has lead to numerous challenges in preventing criminal activity that involves those computing devices.

SUMMARY

A vacuum based apparatus to inhibit relocation of a computing device. The apparatus comprising a first surface of a main body. A suction cup of a shape that is fixed to the main body such that the suction cup of a shape faces outward from and protrudes, at least in part, from the first surface. A spacer that is fixed to the first surface of the main body such that the spacer protrudes outward from the first surface. A vacuum pump that is connected to the suction cup of a shape. A control logic that controls the activation of the vacuum pump. Wherein the suction cup of a shape is connected to the vacuum pump such that activation of the vacuum pump generates a vacuum, the vacuum generating a degree of adhesion between the suction cup of a shape and another surface that is in contact with the suction cup of a shape. Wherein the suction cup of a shape protrudes from the first surface such that contact can be made between the suction cup of a shape and another surface. Wherein the spacer surrounds, at least in part, a section of the suction cup of a shape that protrudes from the first surface.

DETAILED DESCRIPTION

Known preventative measures often include the use of a highly resilient cord that can be attached to the computing device and a secured docking point. For example a steel cord can be used to anchor a laptop to a table. In such a case, both the table and laptop must include brackets (or similar structures) to which the steel cord can be secured. In other known preventative measures the computing device is locked into a docking station, which in turn is attached to a secured docking point. For example, a docking station is attached to a table using bolts that are inaccessible once a laptop is locked into the docking station. The drawback with many of these solutions is the requirement of a specialized surface, e.g., the surface includes holes through which a cord can be passed, or includes an apparatus to secure the computing device.

Figure 1:
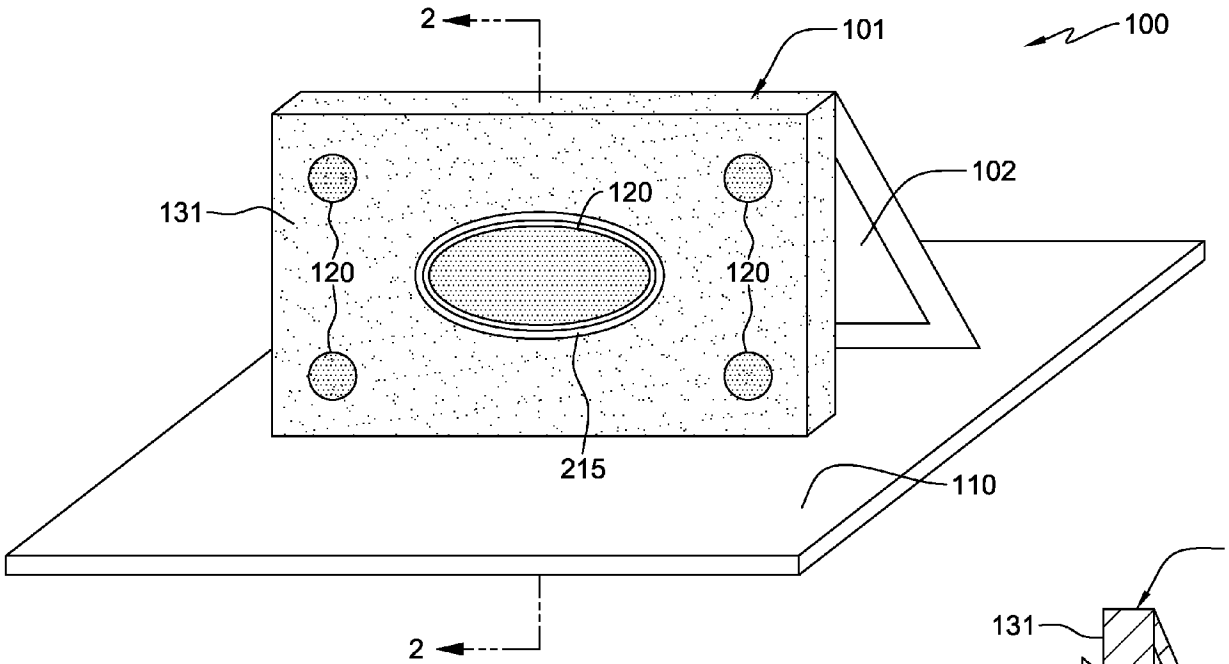
FIG. 1 is a perspective view illustrating a bottom surface of a computing device, in accordance with an embodiment of the present invention.

The present invention will now be described in detail with reference to the Figures. FIG. 1 is a perspective view illustrating a bottom surface of a computing device, 100, in accordance with one embodiment of the present invention. The computing device illustrated in FIG. 1 has been oriented to show the bottom of the computing device. In order for an exemplary embodiment of this invention to operate, the computing device must be configured for use, i.e., oriented such that bottom surface 131 is facing surface 110. In such a configuration computing device 100 is typically resting on surface 110 and bottom surface 131 is within a relatively close proximity to surface 110.

In various embodiments, computing device 100 can be a docking station, a laptop computer, a notebook computer, a video game console, a desktop computer tower, or any other computing device that includes an adhesion system as described herein. It is to be noted that the inclusion of the adhesion system as described herein can transform an otherwise non-computing device into a computing device since the adhesion system itself includes a computing device. In another embodiment, computing device 100 represents a computing system utilizing clustered computers and components to act as a single pool of seamless resources. Computing device 100 may include internal and external hardware components, as depicted and described in further detail with respect to FIG. 6.

In various embodiments of the present invention, computing device 100 includes a display, herein denoted screen 102, and a base herein denoted bottom portion 101, which is indicated by an arrow. Computing device 100 also includes a plurality of suction structures 120, such as suction cups, protruding from bottom surface 131 (of bottom portion 101). Further, a security ring 215 can be seen surrounding the centrally located suction structures 120. It is to be noted that suction structures 120 can be of a variety of shapes and sizes and are not limited to round or cup shapes. In general, suction structure can be, and in many embodiments are, of a variety of shapes and sizes. In general, each suction structures 120 is enclosed by a respective security ring 215, which is addressed below in the discussion of FIGS. 2, 3 and 4. However, to simplify the Figures, only the centrally located suction structures 120 is shown as enclosed by a security ring 215.

Figure 3:
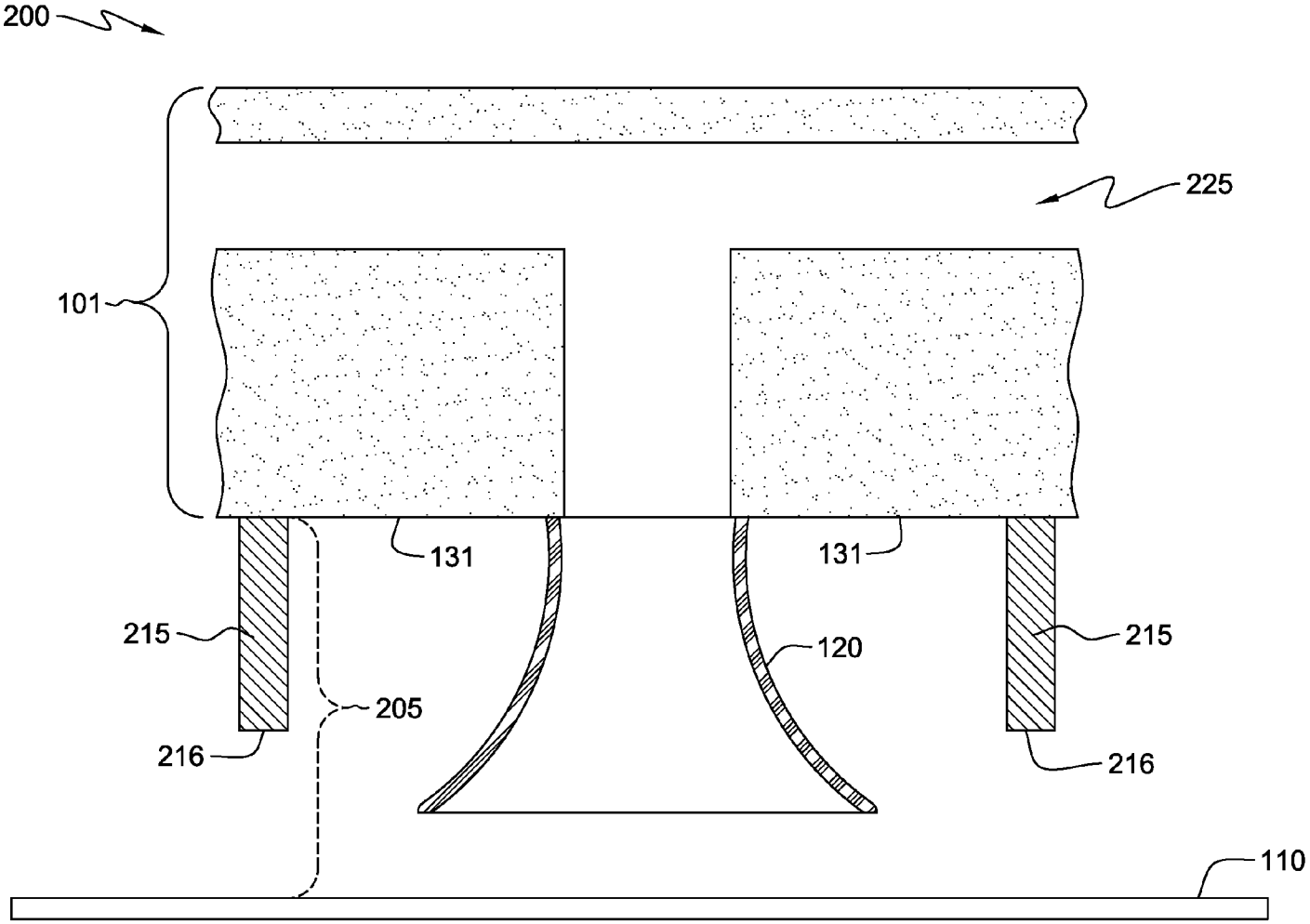
FIG. 3 illustrates a close-up view of a section of the bottom portion of the computing device before the computing device is secured to a surface, in accordance with an embodiment of the present invention.
Figure 4:
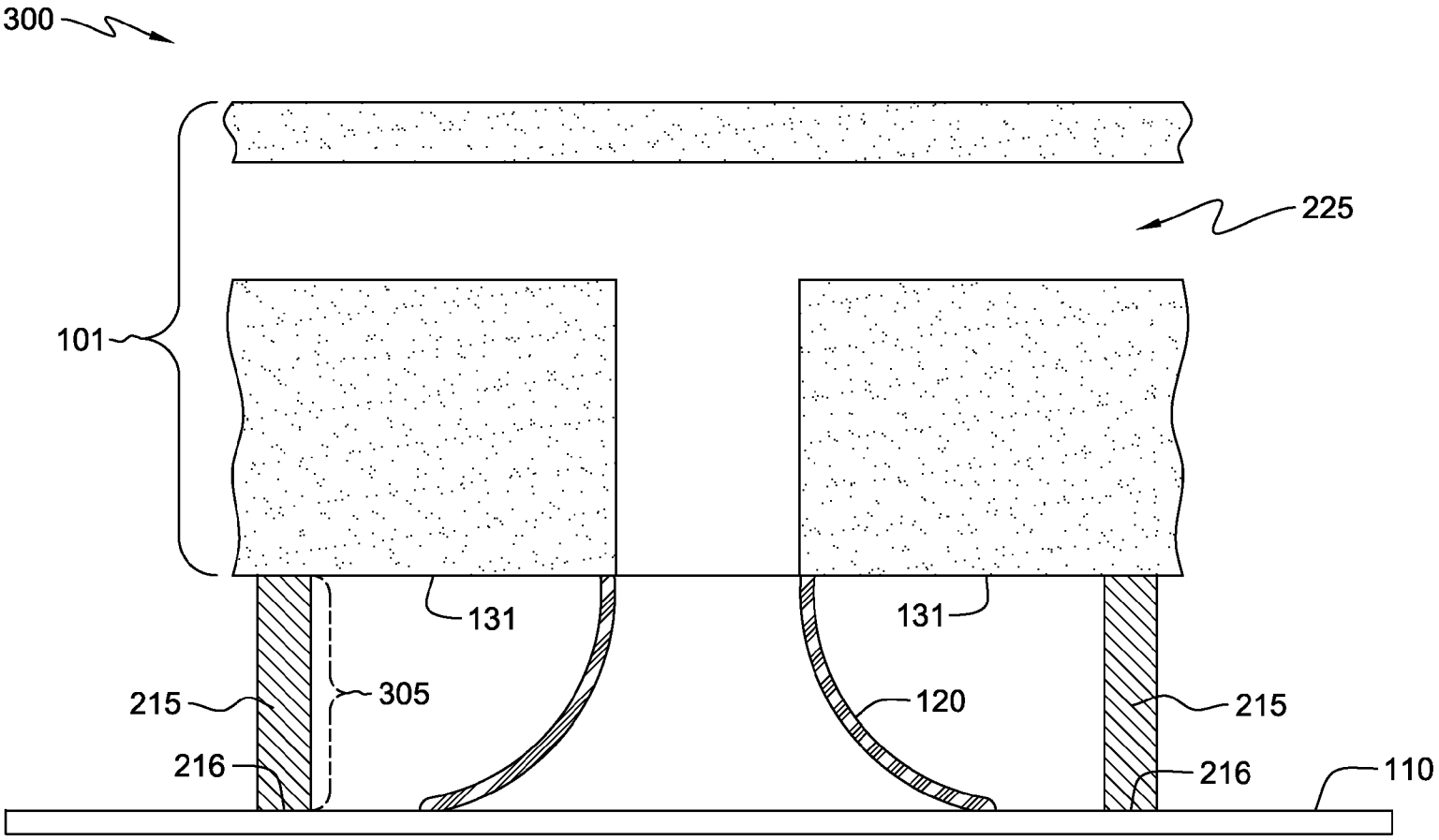
FIG. 4 illustrates a close-up view of the section of the bottom portion of the computing device after the computing device is secured to a surface, in accordance with an embodiment of the present invention.
Figure 5:
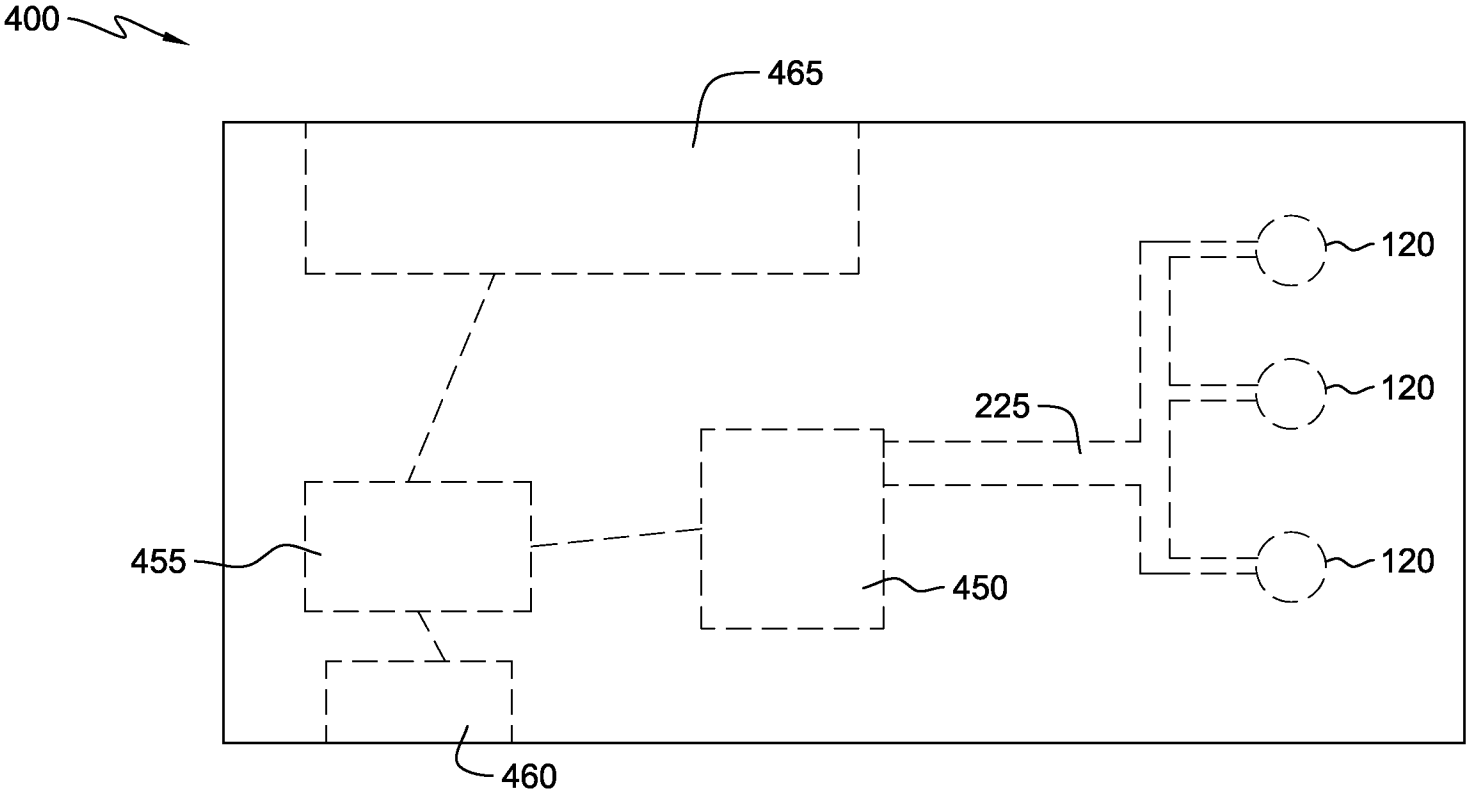
FIG. 5 is a block diagram illustrating a component layout for an adhesion system included in the computing device, in accordance with one embodiment of the present invention.

Each respective suction structures 120 is connected, using an enclosed air channel (herein denoted as vacuum channel 225, which is respectively shown in FIGS. 3, and 4), to a pump that is capable of generating a vacuum (shown as vacuum pump 450 in FIG. 5 only). Vacuum pump 450 is typically included in bottom portion 101 of computing device 100. If computing device 100 is placed on surface 110 such that bottom surface 131 is facing surface 110, then vacuum pump 450 can be activated thereby generating sufficient suction force to adhere computing device 100 to surface 110. For example a laptop computer is placed, in an open configuration, on the surface of a table with the laptop's keyboard facing away from the surface of the table. The vacuum pump is activated and the laptop is adhered via suction cups to the surface of the table. Typically, surface 110 is relatively flat, such as a table or floor, and is sufficiently free of debris such that contact between suction structures 120 and surface 110 is not inhibited, i.e., suction can be formed to adhere computing device 100 to surface 110.

Figure 2:
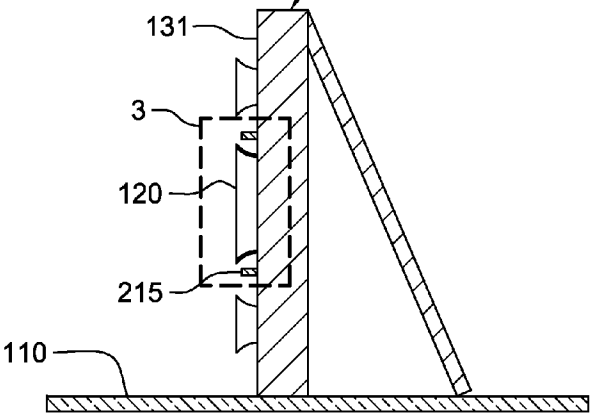
FIG. 2 illustrates a side cutaway view taken about the line 1A-1A of a bottom portion of the computing device before the computing device is secured to a surface, in accordance with an embodiment of the present invention.

FIG. 2 illustrates a side cutaway view taken about the line 1A-1A of bottom portion 101 of computing device 100 before computing device 100 is secured to surface 110, in accordance with an embodiment of the present invention. FIG. 2 includes section 3, which in turn includes the centrally located suction structures 120 which is surrounded by a security ring 215. Section 3 is described in further details in the discussion of FIGS. 3 and 4.

In FIGS. 3 and 4, a close-up view of section 3 of bottom portion 101, which is indicated by a dashed box in FIG. 2, is illustrated. As seen in both FIGS. 3 and 4, bottom portion 101 of computing device 100 has been oriented such that bottom portion 101 both faces and is in close proximity to surface 110.

FIG. 3 illustrates a close-up view, 200, of section 3 of bottom portion 101 before computing device 100 is secured to surface 110, in accordance with one embodiment of the present invention. In FIG. 3, the distance between bottom surface 131 and surface 110 is indicated by dashed bracket 205. Vacuum channel 225 is connected to both suction structures 120 and vacuum pump 450 (as shown in FIG. 5) and allows the flow of air between suction structures 120 and vacuum pump 450, respective to the direction of pumping. As can be seen in FIG. 3, security ring 215 surrounds suction structures 120. It is to be noted that security ring 215 can be of any shape and is not limited to circular or ring related shapes, such as ovals. In most embodiments security ring 215 surrounds the entirety of suction structures 120. In other embodiments, security ring 215 only surrounds a section of suction structures 120. For example, a security ring 215 only encloses the section of suction structures 120 that faces the outer edge of bottom surface 131, i.e., security ring 215 forms a barrier between part of suction structures 120 and the outer edge of bottom surface 131. In some embodiments a single security ring 215 encloses multiple suction structures 120. For example, a laptop has only one security ring 215 that follows the perimeter of bottom surface 131. The laptop also includes several suction structures 120 that are all enclosed by the single security ring 215.

As illustrated in FIG. 3, suction structures 120 is protruding further out from bottom surface 131 than security ring 215. Security ring 215 includes bottom ring surface 216. After vacuum has been applied, i.e., computing device 100 has been secured to surface 110, bottom ring surface 216 is in contact with surface 110, thereby inhibiting the physical insertion of objects under suction structures 120. After computing device 100 has been adhered to surface 110 (see FIG. 3), the inhibition of physical insertion of objects under suction structures 120 can increase the difficulty of forcefully removing computing device 100.

Certain embodiments include a fluid dispensing system that moistens the surface of suction structures 120 that faces surface 110. The addition of a moistening fluid, such as water, can help create an air tight seal along the outer edge of suction structures 120, thereby allowing a vacuum to be formed. Typically, such a fluid would only be applied in small amounts. Such a quantity of fluid can be a predetermined amount, or can be determined by chip program 455. For example, a very fine mist of water is sprayed out of an aerator located in the center of a suction cup. The mist lands on a table generating a surface with increased adhesive potential. After the laptop is removed, the fine layer of water evaporates. It should be noted that certain surfaces can absorb moistening fluids, which can reduce the increase in adhesive potential, or may cause damage to the surface.

FIG. 4 illustrates a close-up view, 300, of section 3 of bottom portion 101 post computing device 100 being secured to surface 110, in accordance with one embodiment of the present invention. To simplify the illustration, only the suction structures 120 that is centrally located on bottom surface 131 is shown, as a close up view, in FIG. 4. Further, in FIG. 4, the distance between bottom surface 131 and surface 110 is indicated by dashed bracket 305. As illustrated in FIG. 4, as vacuum is applied, the space between the bottom surface 131 and surface 110 is reduced, i.e., distance 305 of FIG. 4 is less than distance 205 of FIG. 3. This reduction in space between bottom surface 131 and surface 110 brings bottom ring surface 216, of security ring 215, into contact with surface 110. If an object of sufficient diameter, such as a screw driver, were to be inserted under the suction structures 120 while vacuum was applied, then air would flow into vacuum channel 225, which would reduce the level of adhesion of suction structures 120 to surface 110. For example, a computing device without a security ring is secured to a floor. A screwdriver is inserted between the suction structure and the floor. The inserted screwdriver raises a part of the suction structure creating a gap between the floor and the suction structure through which sufficient air passes to effectively negate the vacuum, thereby releasing the computing device from the floor.

The physical contact of security ring 215 with surface 110 distributes separating forces between multiple suction structures 120. That is, the physical contact of security ring 215 with surface 110 reduces the potential leverage that would be created by moving one part of bottom surface 131 farther away from surface 110 than other parts of bottom surface 131. For example, a laptop is adhered to a table with only one suction cup centrally located in the bottom of the laptop. An individual attempts to lift an edge of the laptop. In such a scenario, the body of the laptop would act as a lever and the suction cup as a pivot point, thereby allowing the laptop to tilt as force is applied by the individual. The leverage allows the individual to overcome the adhesive force and remove the laptop from the table. In another example, each corner of the laptop has a suction cup. The location of the suction cups and their respective security rings greatly reduces the degree of tilting that the individual can generate by applying a lifting force to the laptop's edge. In addition, the lifting force is distributed, at least partly, among the four suction cups, thereby reducing the total lifting force applied per suction cup. Thus, since the leverage is greatly reduced and the lifting force is distributed, the individual can not overcome the adhesive force and fails to remove the laptop from the table. As a result of, and in response to, the above mentioned scenarios, suction structures 120 are spaced apart throughout bottom surface 131, such that the spacing maximizes the potential adhesion of bottom surface 131 to surface 110. Further, the shape of suction structures 120 is selected to enhance the degree of adhesion between bottom surface 131 to surface 110. For example, a suction structure 120 in a corner of bottom surface 131 has a triangular type of shape to better minimize the space between the edge of bottom surface 131 and security ring 215, i.e., the triangular shape of suction structures 120 better fits into the corner of bottom surface 131.

Security ring 215 can include a single ring or multiple rings of various heights, which are composed of various materials. The various materials each have a respective degree of stiffness and hardness. For example, a security ring includes two nesting rings, a shorter outer ring composed of a hard material, and a taller inner ring composed of a comparatively softer material. As vacuum is applied, the distance between the bottom side of the computing device and the surface is reduced. The taller inner ring makes contact with the surface first and is compressed until the harder outer ring makes contact with the surface.

The use of multiple rings can compensate for a degree of surface unevenness. For example, a table is warped from water damage. The computing device includes two security rings. The security rings includes two nesting rings, an outer ring composed of a hard material that can extend and retract until a locking mechanism is activated, and an inner ring composed of a comparatively softer material. As vacuum is applied, the respective inner rings are compressed and the respective outer rings retract to match the change in height of their respective inner ring. The degree of inner ring compression is dependent on the distance between the warped table and the inner ring. Therefore, when the locking mechanism is engaged, locking the outer rings into position, both outer rings are in contact with the warped table but the respective heights of the outer rings are different.

A difference in material of the security rings can also help compensate for different surface textures. For example, the edge of the suction structure is attached to a security ring composed of multiple nesting layers. The layers progress from being tall and soft to shorter and harder such that the shortest and hardest layers are located on the outside of the security ring. As vacuum is applied, the ring compresses. Since the inner layers are soft, the inner layers conform to surface irregularities, which maintains the vacuum and hence the adhesion. The harder outer layers form the barrier required to inhibit insertion of objects between the suction structure and the irregular surface.

In certain embodiments, security ring 215 maintains a minimum distance between bottom surface 131 and surface 110. The minimum distance allows for sufficient air to flow into computing device 100, allowing an acceptable operating temperature to be maintained.

FIG. 5 is a block diagram illustrating a component layout for an adhesion system, 400, included in computing device 100, in accordance with one embodiment of the present invention. FIG. 5 illustrates some of the internal components included in bottom portion 101. The component layout, as illustrated in FIG. 5, is intended to show the general connectivity between the components included in adhesion system 400. As such, this block diagram is not to be interpreted as a limitation in component placement or quantity. Adhesion system 400 includes chip program 455 which controls the adhesion of computing device 100 to a surface. Adhesion system 400 further includes a main battery, herein denoted as main battery 465, which provides the main source of power, which is required by computing device 100 to operate. Adhesion system 400 also includes a backup battery, herein denoted as adhesion battery 460, which provides power to adhesion system 400 in the event that power is no longer available from main battery 465. As seen in FIG. 5, chip program 455 is electrically connected to both main battery 465 and adhesion battery 460. Chip program 455 is further electrically connected to and controls the activation of vacuum pump 450, i.e., chip program 455 controls the activity of adhesion system 400. As illustrated in FIG. 5, vacuum pump 450 is connected to vacuum channel 225, which is in turn connected to suction structures 120. As indicated in the discussion of FIG. 1, in most embodiments there are several suction structures 120 connected to vacuum pump 450. However, for simplicity, FIG. 5 only illustrates three suction structures 120 connected to vacuum pump 450.

Chip program 455 is an integrated circuit with a memory that includes a program to control the activation of the adhesion system. Chip program 455 also has the processing power to execute the program that controls the activation of the adhesion system. In this embodiment, the program includes a graphical user interface allowing a user of the computing device to control the activity of the program. In general, the program responds to the commands and activities of the user operating computing device 100. The program also responds to sensor input received from sensors (not shown herein) that are included in most embodiments. For example, a vacuum sensor indicates that there has been a loss in vacuum, i.e., a reduced degree of vacuum. The program activates the vacuum pump and restores the vacuum pressure. If vacuum pressure can not be restored, then the program sounds an alarm. In a continuation with this example, if the computing device is forcefully removed from the surface, then the program sounds an alarm to alert the user. In another example, the user locks the computer screen, in response the program uses a sensor to determine if there is a surface within proximity for adhesion. In response to sensor input indicating that a table is within adhesion range, i.e., within the proximity for adhesion, chip program 455 activates the vacuum pump thereby adhering the computing device to the surface of the table, which prevents undesired removal of the computing device. In yet another example, the program determines, via motion sensor input, that a forceful removal of the computing device is being attempted. In response to this determination, the chip program 455 activates the vacuum pump and increases the level of adhesion to its maximum point. In a last example, the program determines that the main battery has been removed from the computing device while the screen is locked. In response to this determination, the program activates the vacuum pump and increases the level of adhesion to its maximum point.

As vacuum is increased, via the action of vacuum pump 450, suction structures 120 generate a level of adhesion thereby adhering computing device 100 to a surface (as shown in FIG. 4). If the amount of vacuum is increased then the degree of adhesion will correspondingly increase (until a maximum level of adhesion is reached). For example, a suction cup, protruding from the bottom surface of a computing device, is in contact with a clean table. After activation of the vacuum pump, the suction cups generate a first level of adhesive force. The first level of adhesive force is sufficient to secure the computing device to the table such that normal use of the computing device by a user does not cause undesired movement of the computing device on the table. Then, the user locks the computer screen so they can leave and retrieve a tasty beverage. In response to the locked screen, chip program 455 activates vacuum pump 450, which increases the degree of vacuum, thereby generating a second level of adhesive force. The second level of adhesive force is sufficient to deter the forceful removal of the computing device by another individual. In some embodiments, different levels of adhesions are created by selective activation of various suction structures 120. For example, only three suction structures 120 are activated during regular use of a laptop. However, the locking of the screen activates six additional suction structures 120.

In certain embodiments, the direction of air flow, created by vacuum pump 450, can be reversed by chip program 455. The reversal of air flow direction can be in response to a failed attempt to generate adhesion. For example, there is sufficient debris between the surface and the suction structure to prevent generation of, or maintenance of, a vacuum. In such a situation the reversal of air flow direction can aid in clearing the debris from in between the surface and the suction structure.

In certain embodiments, backup battery 460 is directly connected to vacuum pump 450. In such an embodiment, if main battery 465 is removed, then, without direction from chip program 455, vacuum pump 450 will activate as needed to maintain a specified degree of vacuum, i.e., adhesion. Such activation can be controlled using sensor input, e.g., a vacuum sensor can activate the vacuum pump as the level of vacuum drops below a threshold.

Certain embodiments include an override mechanism to deactivate adhesion system 400. Such an override mechanism can be activated in a situation where the computing device is no longer functional, e.g., the hard drive of the computing system fails. Typically, such an override mechanism would include sufficient security measures to prevent unauthorized activation of the override mechanism.

In certain embodiments, one or more of the components, in whole or in part, that are included in adhesion system 400 are integral to computing device 100. For example, computing device 100 includes a memory that contains the programming of chip program 455. Computing device 100 uses that programming to control the activity of other components included in adhesion system 400.

In certain embodiments, the programming included in chip program 455 can be stored on any computer-readable media that is accessible by computing device 100. Any combination of computer-readable media may be utilized. Computer-readable media may be a computer-readable signal medium or a computer-readable storage medium. A computer-readable storage medium may be, for example, but not limited to, an electronic, magnetic, optical, electromagnetic, infrared, or semiconductor system, apparatus, or device, or any suitable combination of the foregoing. More specific examples (a non-exhaustive list) of a computer-readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer-readable storage medium may be any tangible medium that can contain, or store a program for use by or in connection with an instruction execution system, apparatus, or device.

A computer-readable signal medium may include a propagated data signal with computer-readable program code embodied therein, for example, in baseband or as part of a carrier wave. Such a propagated signal may take any of a variety of forms, including, but not limited to, electromagnetic, optical, or any suitable combination thereof. A computer-readable signal medium may be any computer-readable medium that is not a computer-readable storage medium and that can communicate, propagate, or transport a program for use by or in connection with an instruction execution system, apparatus, or device.

Program code embodied on a computer-readable medium may be transmitted using any appropriate medium, including but not limited to wireless, wireline, optical fiber cable, RF, etc., or any suitable combination of the foregoing.

In certain embodiments, the programming included in chip program 455 can be stored externally to computing device 100 and accessed through a network. The network can be, for example, a local area network (LAN), a wide area network (WAN) such as the Internet, or a combination of the two, and may include wired, wireless, fiber optic or any other connection known in the art. In general, the network can be any combination of connections and protocols that will support communications between computing device 100 and the programming included in chip program 455, or provide computing device 100 access to the programming included in chip program 455.

Computer program code for carrying out operations for aspects of the present invention may be written in any combination of one or more programming languages, including an object oriented programming language such as Java™, Smalltalk, C++ or the like and conventional procedural programming languages, such as the "C" programming language or similar programming languages. The program code may execute entirely on a user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Figure 6:
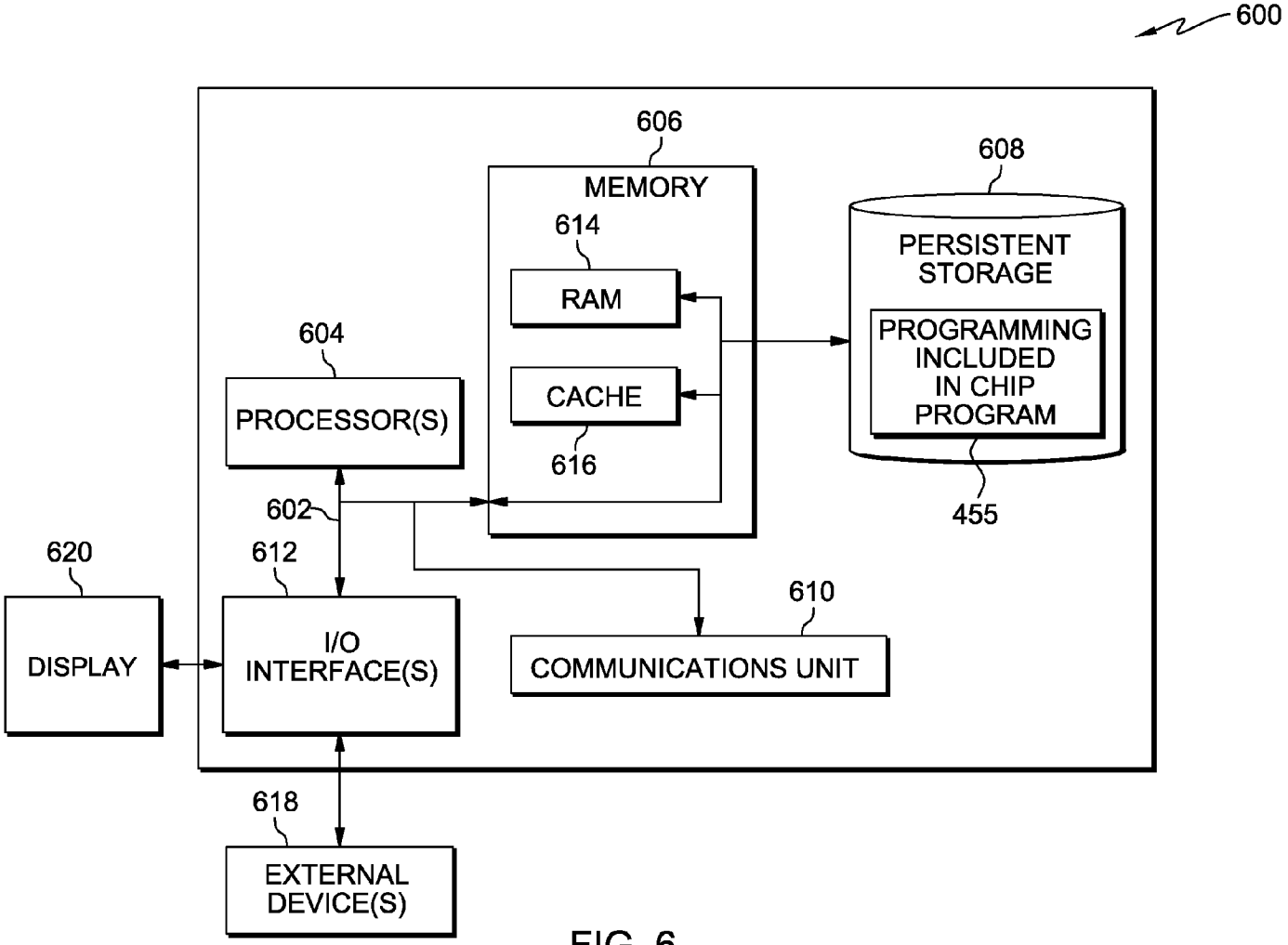
FIG. 6 depicts a block diagram of components of the computing device, in accordance with an exemplary embodiment of the present invention.

FIG. 6 depicts a block diagram, 600, of components of computing device 100, in accordance with an illustrative embodiment of the present invention. It should be appreciated that FIG. 6 provides only an illustration of one implementation and does not imply any limitations with regard to the environments in which different embodiments may be implemented. Many modifications to the depicted environment may be made. In certain embodiments, the components and programming included in adhesion system 400 are integral with the components and programming of computing device 100.

Computing device 100 includes communications fabric 602, which provides communications between computer processor(s) 604, memory 606, persistent storage 608, communications unit 610, and input/output (I/O) interface(s) 612. Communications fabric 602 can be implemented with any architecture designed for passing data and/or control information between processors (such as microprocessors, communications and network processors, etc.), system memory, peripheral devices, and any other hardware components within a system. For example, communications fabric 602 can be implemented with one or more buses.

Memory 606 and persistent storage 608 are computer-readable storage media. In this embodiment, memory 606 includes random access memory (RAM) 614 and cache memory 616. In general, memory 606 can include any suitable volatile or non-volatile computer-readable storage media.

In certain embodiments, the programming included in chip program 455 is stored in persistent storage 608 for execution and/or access by one or more of the respective computer processors 604 via one or more memories of memory 606. In this embodiment, persistent storage 608 includes a magnetic hard disk drive. Alternatively, or in addition to a magnetic hard disk drive, persistent storage 608 can include a solid state hard drive, a semiconductor storage device, read-only memory (ROM), erasable programmable read-only memory (EPROM), flash memory, or any other computer-readable storage media that is capable of storing program instructions or digital information.

The media used by persistent storage 608 may also be removable. For example, a removable hard drive may be used for persistent storage 608. Other examples include optical and magnetic disks, thumb drives, and smart cards that are inserted into a drive for transfer onto another computer-readable storage medium that is also part of persistent storage 608.

Communications unit 610, in these examples, provides for communications with other data processing systems or devices that are in communication with computing device 100. In these examples, communications unit 610 includes one or more network interface cards. Communications unit 610 may provide communications through the use of either or both physical and wireless communications links. The programming included in chip program 455 may be downloaded to persistent storage 608 through communications unit 610.

I/O interface(s) 612 allows for input and output of data with other devices that may be connected to computing device 100. For example, I/O interface 612 may provide a connection to external devices 618 such as a keyboard, keypad, a touch screen, and/or some other suitable input device. External devices 618 can also include portable computer-readable storage media such as, for example, thumb drives, portable optical or magnetic disks, and memory cards. Software and data used to practice embodiments of the present invention, e.g., the programming included in chip program 455, can be stored on such portable computer-readable storage media and can be loaded onto persistent storage 608 via I/O interface(s) 612. I/O interface (s) 612 also connect to a display 620.

Display 620 provides a mechanism to display data to a user and may be, for example, a computer monitor, such as screen 102, or a television screen.

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

Having described the preferred embodiment of creating an adhesion system using the aforementioned devices and structures (which are intended to be illustrative and not limiting), it is noted that modifications and variations may be made by persons skilled in the art in light of the above teachings.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description. A reference to an element in the singular is not intended to mean "one and only one" unless specifically stated, but rather "one or more." All structural and functional equivalents to the elements of the various embodiments described throughout this disclosure that are known or later come to be known to those of ordinary skill in the art are expressly incorporated herein by reference and intended to be encompassed by the invention. It is therefore to be understood that changes may be made in the particular embodiments disclosed which are within the scope of the present invention as outlined by the appended claims.

Each respective figure, in addition to illustrating the structure of the present invention at various stages, also illustrates the respective steps of the method for the fabrication/manufacture of such an adhesion system using the aforementioned devices and structures.

What is claimed is:

1. A vacuum based apparatus to inhibit relocation of a computing device, the apparatus comprising:

a first surface of a main body; a suction cup of a shape, the suction cup of a shape being fixed to the main body such that the suction cup of a shape faces outward from and protrudes, at least in part, from the first surface;

a spacer, the spacer being fixed to the first surface of the main body such that the spacer protrudes outward from the first surface;

a vacuum pump, the vacuum pump being connected to the suction cup of a shape;

a control logic that controls the activation of the vacuum pump; wherein the suction cup of a shape is connected to the vacuum pump such that activation of the vacuum pump generates a vacuum, the vacuum generating a degree of adhesion between the suction cup of a shape and another surface that is in contact with the suction cup of a shape;

wherein the suction cup of a shape protrudes from the first surface such that contact can be made between the suction cup of a shape and another surface; and wherein the spacer surrounds, at least in part, a section of the suction cup of a shape that protrudes from the first surface, and wherein the spacer includes a plurality of nesting layers, the nesting layers are composed of materials with varying degrees of stiffness and hardness.

2. The apparatus of claim 1, the apparatus further comprising one or more electric power sources, wherein the electric power sources supplies power to the control logic and the vacuum pump.

3. The apparatus of claim 1, the apparatus further comprising: a vacuum sensor, wherein the vacuum sensor provides an indication of a degree of vacuum; and control logic to respond to a loss of adhesion by triggering an alarm.

4. The apparatus of claim 1, wherein the spacer inhibits insertion of an object between the suction cup of a shape and a given surface to which the suction cup of a shape is adhered post activation of the vacuum pump.

5. The apparatus of claim 1, wherein the main body is included as part of a computing device.

6. The apparatus of claim 1, wherein the nesting layers with lower degrees of stiffness conform to irregularities in the surface to a greater degree than the nesting layers with higher degrees of stiffness conform to irregularities of a given surface to which the main body is adhered.

7. The apparatus of claim 4, wherein the spacer extends and retracts to accommodate a change in a distance between the first surface of the main body and another surface.

8. The apparatus of claim 7, the apparatus further comprising: a locking mechanism to prevent extension and retraction of the spacer layer; and an unlocking device that permits extension and retraction of the spacer layer.

9. The apparatus of claim 1, wherein the suction cup of a shape is a plurality of suction cup of a shape.

10. The apparatus of claim 9, wherein the plurality of suction cup of a shape are spaced apart throughout the first surface, wherein the spacing enhances adhesion between the main body and a given surface to which the main body is adhered.

11. The apparatus of claim 4, wherein the shape of the suction cup of a shape is selected to enhance a degree of adhesion between the main body and another surface.

12. The apparatus of claim 5, wherein the computing device is selected from a group consisting of a laptop computer, a tablet computer, a video game consol, and a desktop computer tower.

13. The apparatus of claim 1, wherein the main body is included as part of a docking station for a computing device.

14. The apparatus of claim 1, wherein the control logic includes a graphical user interface that allows a user to control the activity of the apparatus.

15. The apparatus of claim 1, the apparatus further comprising: at least one sensor to detect an attempt to forcefully remove the main body from a given surface when the main body is adhered to that surface; and control logic to respond to the detection of an attempt to forcefully remove the main body from a given surface to which the main body is adhered by triggering an alarm or by increasing a level of adhesion between the main body and that surface.

16. The apparatus of claim 2, the apparatus further comprising: at least one sensor to detect removal of at least one of the one or more electric power sources from the main body; and control logic to respond to the detection of an unauthorized removal of at least one of the one or more electric power sources by triggering an alarm or by increasing a level of vacuum if the main body is adhered to a given surface.

17. The apparatus of claim 5, wherein the control logic responds to the locking of a display of the computing device by adhering the main body to a given surface if that surface is within a proximity to the first surface.

* * * * *